US005401228A

United States Patent [19]

McLaughlin

[11] Patent Number: 5,401,228

[45] Date of Patent: Mar. 28, 1995

[54] ABDOMINAL EXERCISER

[76] Inventor: Gary McLaughlin, 13300 Wingo St., Arleta, Calif. 91331

[21] Appl. No.: 71,484

[22] Filed: Jun. 4, 1993

Related U.S. Application Data

[63] Continuation-in-part of Ser. No. 809,088, Dec. 10, 1991, abandoned, which is a continuation of Ser. No. 566,133, May 27, 1990, abandoned.

[51] Int. Cl.[6] ..... A63B 23/02

[52] U.S. Cl. ..... 482/105; 482/148

[58] Field of Search ..... 482/105, 148; 405/186

[56] References Cited

U.S. PATENT DOCUMENTS

| | | | |
|---|---|---|---|
| 2,163,107 | 6/1939 | Shatto et al. | 482/105 |
| 2,970,448 | 2/1961 | Di Julio | 482/105 X |
| 3,039,273 | 6/1962 | Swindell | 482/105 X |
| 3,192,723 | 7/1965 | Apperson | 482/105 X |
| 3,470,570 | 10/1969 | Christiansen | 482/105 X |
| 3,735,598 | 5/1973 | Oeland, Jr. | 482/105 X |
| 3,924,616 | 12/1975 | Banjavich et al. | 405/186 X |
| 4,239,211 | 12/1980 | Wilkerson | 482/105 |
| 4,775,148 | 10/1988 | McLaughlin | 482/105 X |
| 4,789,270 | 12/1988 | Selisky | 482/105 X |

FOREIGN PATENT DOCUMENTS 3736 of 1887 United Kingdom ..... 482/105

*Primary Examiner*—Richard J. Apley
*Assistant Examiner*—John Mulcahy
*Attorney, Agent, or Firm*—Lawrence S. Cohen; Timothy T. Tyson

[57] ABSTRACT

An exerciser for the abdominal muscles. A shell (22) has a weight (24) attached to it by means of a belt (30). The shell (22) is formed such as to present an edge (26). The shell (22) is attached to the waist by a second belt (34) so that the edge (26) is brought to bear against the abdominal muscles selected by the user. The muscles selected by the edge (26) are exercised by exerting them against the resistive force of the weight. Tactile feedback from the edge (26) is used to assure the exercise of the desired muscle group. The abdominal muscles are exercised by holding the edge (26) in place centrally and vertically on the abdomen A and exerting and relaxing the abdominal muscles against the edge. Alternatively, the edge may be forced against the abdominal muscles; handgrips may be provided for this purpose.

7 Claims, 5 Drawing Sheets

ABDOMINAL EXERCISER

This is a continuation-in-part of application Ser. No. 07/809,088, filed on Dec. 10, 1991, now abandoned, which is a continuation of application Ser. No. 07/566,133, filed May 27, 1990, now abandoned, the contents of which are incorporated herein by this reference.

TECHNICAL FIELD

The present invention pertains to the exercising equipment art, and more particularly, to an exerciser attached to the user by a belt for exercising the abdominal muscles.

BACKGROUND ART

Various types of apparatus have been devised to aid in exercising muscles by exerting a muscle or muscle group against the opposing force of a weight, a spring, a resilient band or another muscle. One example is U.S. Pat. No. 2,613,932 to Manners for an apparatus that enables the legs to work against the force of springs attached to the shoulders. Another is U.S. Pat. No. 3,162,441 to Karlik which utilizes an arrangement of cables to allow the user to move arms and legs in opposition to each other. In U.S. Pat. No. 4,441,707 to Bosch the arm muscles can work against each other by means of a line that goes around the user's back.

Apparatus have also been devised specifically for exercise of the abdominal muscles. U.S. Pat. No. 4,775,148 to the present inventor employs a spring and belt combination by which the user can exert the abdominal muscles against the resistive force of a spring. U.S. Pat. No. 4,824,105 to Goldenberg has an inflatable bag that presses inward upon the abdomen for the same purpose.

The apparatus described above place the external force, to be resisted, generally over the entire abdominal area. It would be convenient be able to localize the muscle area upon which the external force is brought to bear. The user could then select particular muscle groups to exercise. The user could also work upon increasing the definition of certain abdominal muscles. It follows, therefore, that an apparatus which would allow the user to apply an external force against selected abdominal muscles would have considerable utility.

DISCLOSURE OF INVENTION

In accordance, therefore, with an embodiment of the present invention, an apparatus is provided that enables the user of the apparatus to apply a resistive force upon a selected area of the abdomen.

In accordance with an embodiment of the invention, a shell having a long edge and weight sufficient to impose a resistive force upon the muscles is attached to the abdomen. The edge can be moved, by means of adjusting a belt that passes around the user's back, so as to localize the force of the weight on the muscle group selected by the user.

In accordance with another embodiment of the present invention, a separate weight may be combined with the shell to provide the required resistive force. In accordance with another aspect of the present invention, a resilient belt may be used to attach the shell to the abdomen so as to apply another resistive force to the selected abdominal muscles. This resistive force would not rely on gravity and could be used in positions not otherwise convenient.

The novel features of the invention are set forth with particularity in the appended claims. The invention will be best understood from the following description when read in conjunction with the accompanying drawings.

BRIEF DESCRIPTION OF DRAWINGS

Incorporated as part of the description, in order to illustrate embodiments and principles of the present invention, are the accompanying drawings, wherein.

MODES FOR CARRYING OUT THE INVENTION

Figure 1:
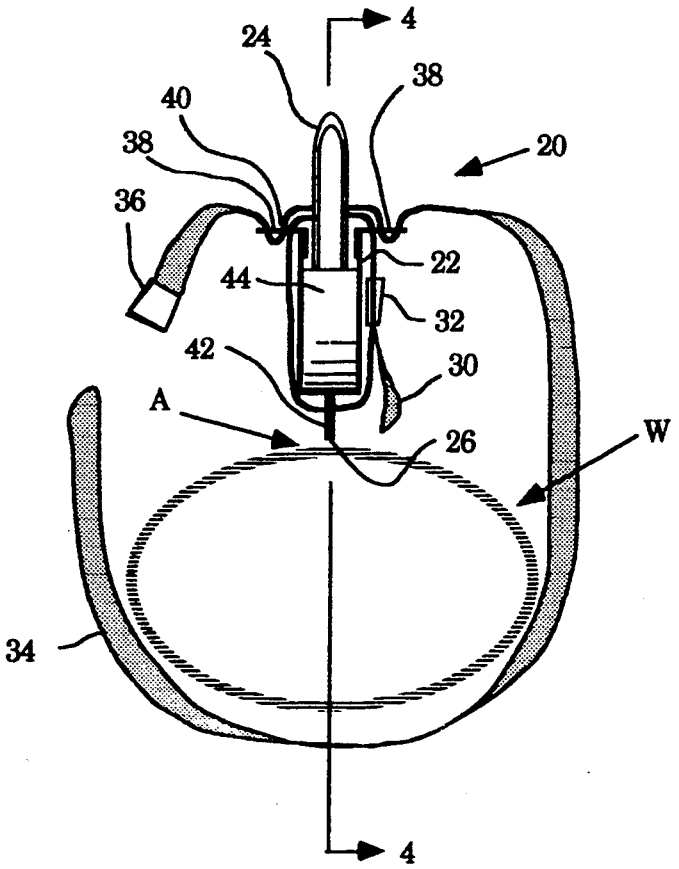
FIG. 1 is a front elevation view of an abdominal exerciser, in accordance with a preferred embodiment of the present invention.

Referring to FIG. 1, which is a front elevation view of an embodiment of the present invention, there is illustrated one position in which the abdominal exerciser could be used with respect to the user's body while lying down. The cross section of the waist W of the user is denoted by an oval shape and the abdominal area A indicated thereon. The exerciser 20, in this embodiment, has a shell 22 and a weight 24. A pair of brackets 38, each having slots 40, and a pair of sides 42, each having an aperture 46 (FIG. 2), are parts of the shell 22. The assembly of the brackets 38 and the sides 42 is best understood by referring to the sectional view of FIG. 5. The slots 40 are best seen in FIG. 3. The weight 24 may be of the type used with bar bells, having a hole 28 (best seen in FIG. 2) through the middle, although other forms of weights could be used equally well. Weights of five and ten pounds have been found to be useful for proper exercise using the invention, with the weight of five pounds being preferred. Heavier or lighter weights may be used as desired.

Means for integrating the weight 24 with the shell 22 is provided in the form of a belt 30 which is threaded through the hole 28 of the weight 24, the inner two slots 40 of the brackets 38 and the apertures 46 in the sides 42 so as to hold the weight 24 securely to the shell 22. Means for adjusting the girth of the belt 30, such as a buckle 32, may be located thereon. The buckle 32 may be of the type utilizing a pivoted arm which is closed tighter by tension on the belt 30, or equally well may be of the type employing a tongue that fits into a hole in the belt 30. Another means for adjusting the girth of the belt 30 may be a hook and loop type of fastener located on the belt 30.

Means for attaching the shell 22 about the abdomen A of the user is provided in the form of another belt 34 which also threads through the slots 40 in the brackets 38 as shown (see also FIG. 3). Means for adjusting the girth of the belt 34, such as a buckle 36, may be located thereon and may be of the forms described for the buckle 32. The sides 42 of the shell 22 are formed and joined so as to create an edge 26 which is shown positioned at the centerline of the abdominal area. However, the edge 26 may be moved horizontally and vertically in order to press against those muscle groups selected by the user.

The edge is narrow enough to give feedback to the user allowing him to exercise the desired muscles and yet it is not so sharp as to be uncomfortable. An edge with a width of less than one half inch and less than twelve inches in length has been found to be useful for proper use of the invention by providing adequate tactile feedback to the user to allow him to continuously identify the muscles that need to be exercised. An edge of one eighth of an inch and length of six inches has been found to be preferred. Prior art devices have flat areas pressing against the body which do not give adequate feedback to the user to allow ready identification of the desired muscle group.

In one mode of using this embodiment of the invention, the user, with the exerciser 20 attached by means of the strap 34 and buckle 38, lies upon his back and exercises the abdominal muscles by placing the edge 26 against a selected muscle group and exerting this group against the force induced by gravity in the weight 24. Tactile feedback from the edge 26 to the muscle group assures the user that the edge 26 is properly placed. The belt 34 may also be resilient and in this embodiment of the invention the user could stand and exert the selected muscles against the resistant force of the belt 34. In this mode of use the muscles may also be exercised by overcoming the inertia of the weight 24 which will resist sudden changes of its position.

Figure 2:
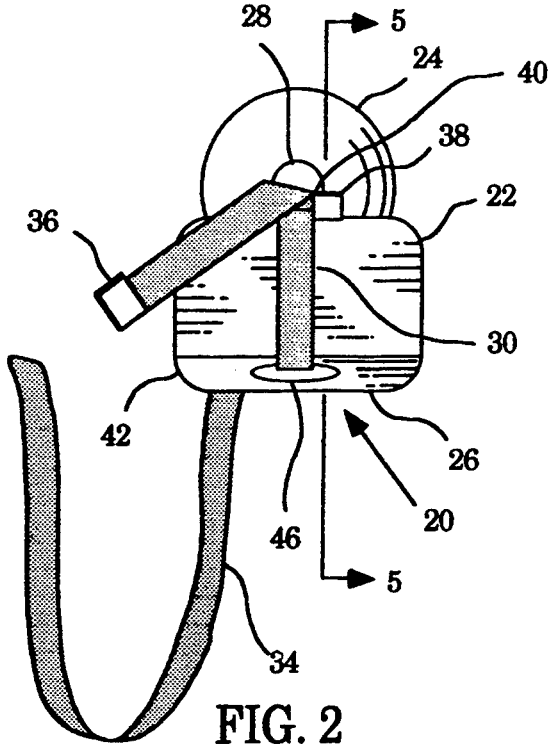
FIG. 2 is a side elevation view of the abdominal exerciser of FIG. 1.
Figure 3:
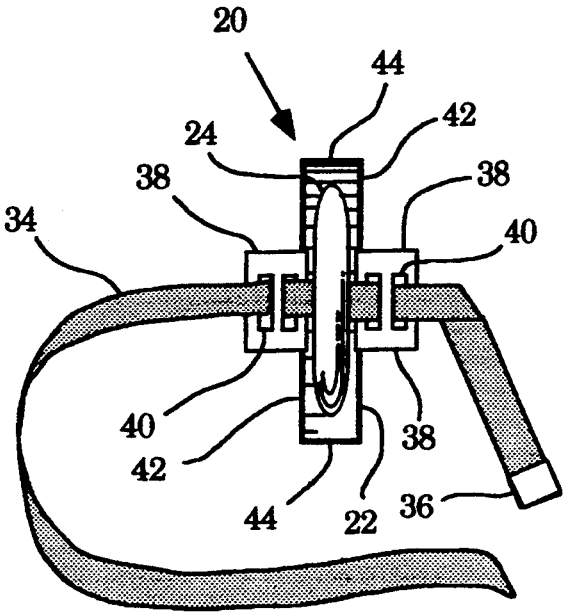
FIG. 3 is a top plan view of the abdominal exerciser of FIG. 1.

FIG. 2 illustrates a side elevation view of the exerciser 20. The weight 24 is shown held in the shell 22 by the belt 30 which threads through the hole 28 in the weight 24, the slots 40 in brackets 38 and the apertures 46 in the sides 42. The belt 34 with attached buckle 36 is shown threaded through the slots 40 in brackets 38.

FIG. 3 is a top plan view of the exerciser 20 showing the shell 22 and the weight 24. The method of threading the belt 34 through the slots 40, of the brackets 38, is apparent.

Figure 4:
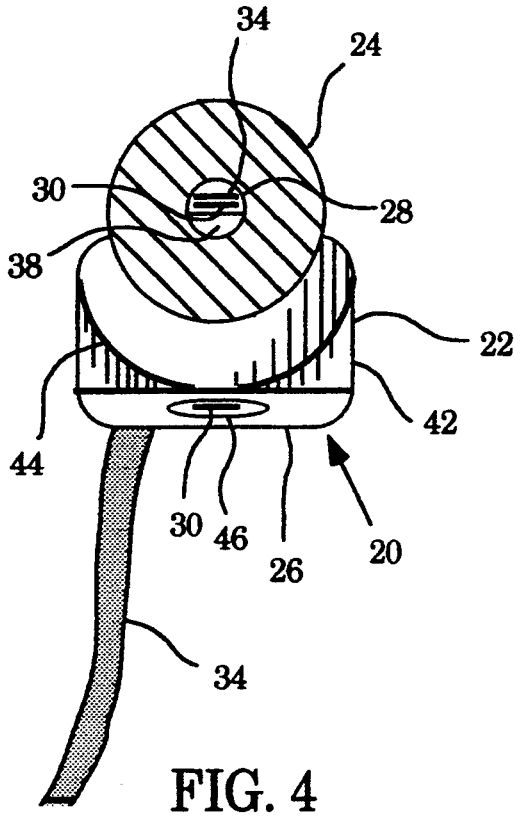
FIG. 4 is a view along the line 4—4 of FIG. 1.

FIG. 4 is a sectional view along the line 4—4 of FIG. 1 and best illustrates the arcuate shaped stiffners 44 which are parts of the shell 22. The stiffners 44 may also be of one piece. Belts 30 and 34 are illustrated as they thread through the hole 28 in the weight 24. Belt 30 is also seen in the aperture 46 of the side 42.

Figure 5:
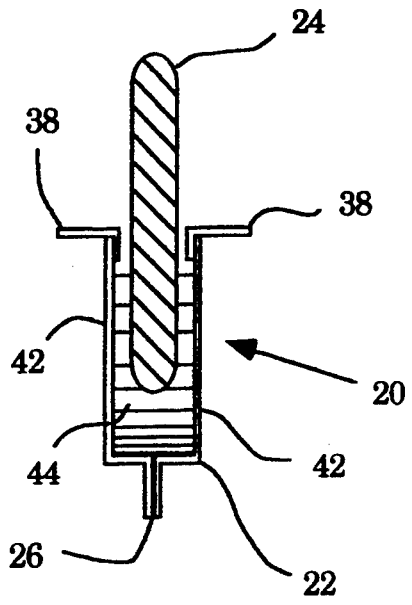
FIG. 5 is a view along the line 5—5 of FIG. 2.

FIG. 5 is a sectional view along the line 5—5 of FIG. 2 and best illustrates, along with FIG. 4, the elements of the shell 22. A pair of L shaped brackets 38 are attached to a pair of sides 42. The lower stiffner 44 is attached to the sides 42. As illustrated in FIG. 5, the ends of the sides 42 form the edge 26.

Figure 6:
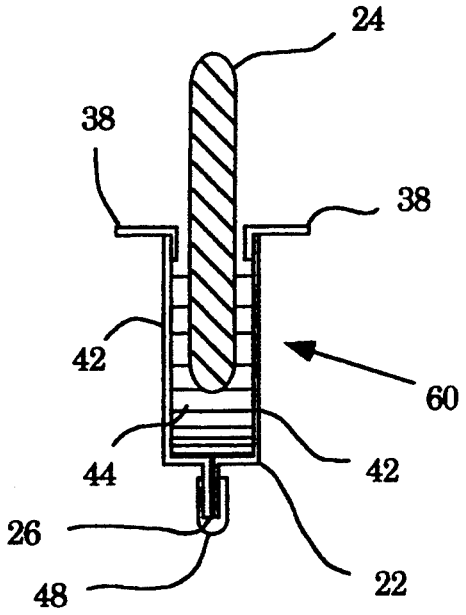
FIG. 6 is a view similar to FIG. 5.

In accordance with another embodiment of the present invention, FIG. 6 illustrates, in a sectional view similar to FIG. 5, the addition of a resilient cover 48 attached to the edge 26 of the exerciser 60 so as to soften the contact of the edge 26 with the abdominal muscles. The cover 48 may also help to prevent chafing of the skin. The cover 48 may be attached to the edge 26 with a suitable adhesive.

The brackets 38, stiffners 44 and sides 42 may be of light aluminum or steel and welded together. The shell may also be molded from rigid plastic. In another embodiment of the present invention, weight in the form of lead sheets or other dense material could be embedded in the molded shell. In this embodiment, there would be no need for a separate weight.

It may be seen that an abdominal muscle exerciser has been provided and that the application of the exerciser may be used selectively by adjusting the location of the edge 26 in relation to the abdominal muscles.

Figure 7:
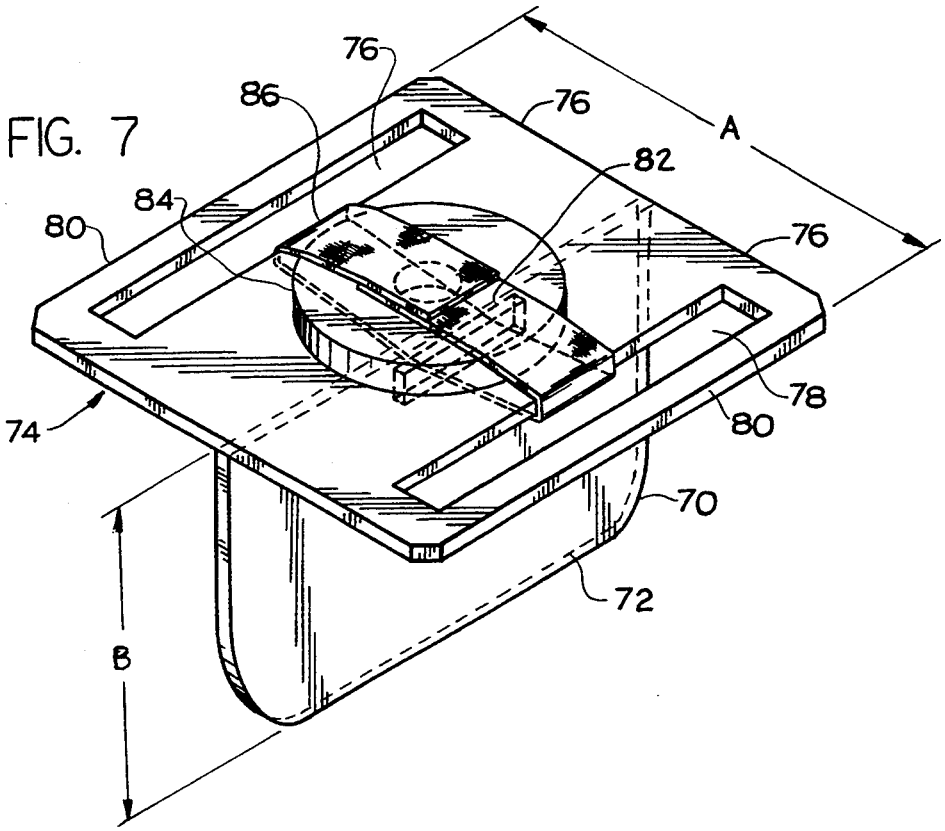
FIG. 7 is a perspective view of an alternative embodiment of the invention.

FIG. 7 illustrates an alternative embodiment in which a lower portion comprising a blade 70 is oriented vertically to present a long narrow free surface 72 facing downwardly. Spaced above the blade 70 and rigidly attached to it is a holding structure 74 which is rigidly attached to the blade 70. The holding structure 74 is a flat plate having lateral extensions 76 each of which extend an equal distance, laterally to each side of the blade 70. There is an elongated slot 78 in each of the lateral extensions 76, the slots extending lengthwise of the lateral extension 76 parallel with the direction of the free surface 72 and spaced from the outer extremity 80 of the respective lateral extensions.

Also shown is a rectangular slot 82 in the blade 70, and weight 84 set on top of the holding structure 74 which is held down by a strap 86 which extends around the weight 84, and through each of slots 78 and the slot 82. As illustrated the ends of the strap 86 are connected by a hook and loop fastener, although any kind of fastener could be used.

The entire structure of the blade 70 and the structure 74 is made of a rigid material such as metal or strong plastic.

The lateral extensions 76 and their respective slots 78 could be formed as convenient hand grips in the area of the outer extremity 80.

The device can be equipped with a strap which is not shown in FIG. 7, but is described above, to go around the user's body. When the strap is used it can be looped through slots 84.

Figure 8:
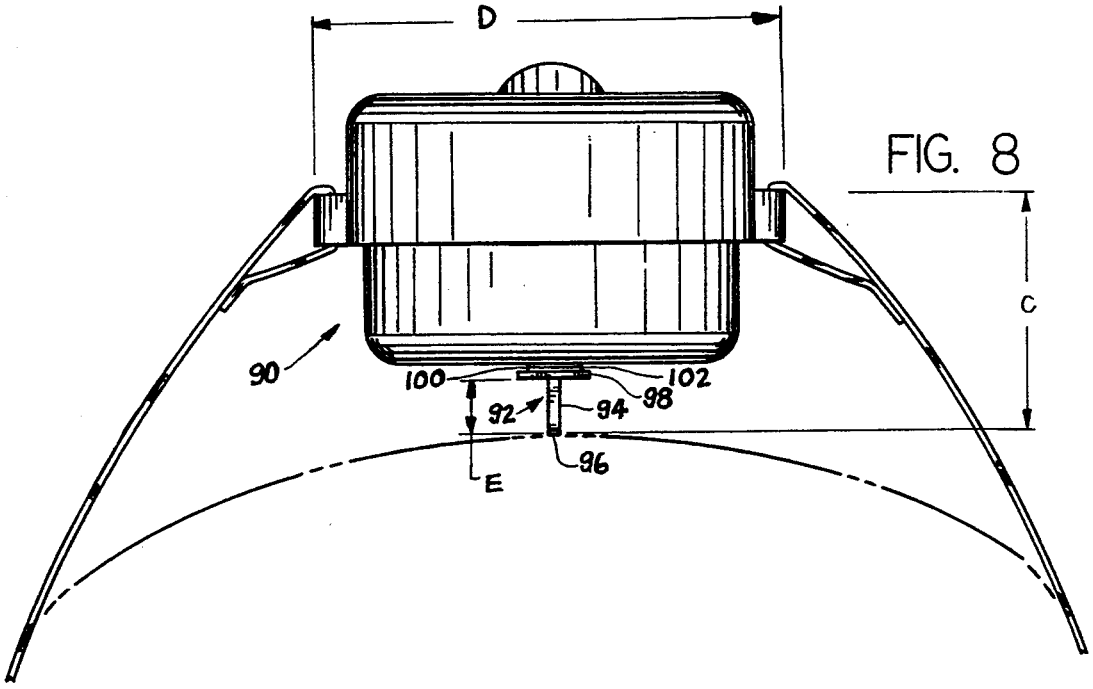
FIG. 8 is a view looking upward from the feet of a user of another alternative embodiment of the invention.
Figure 9:
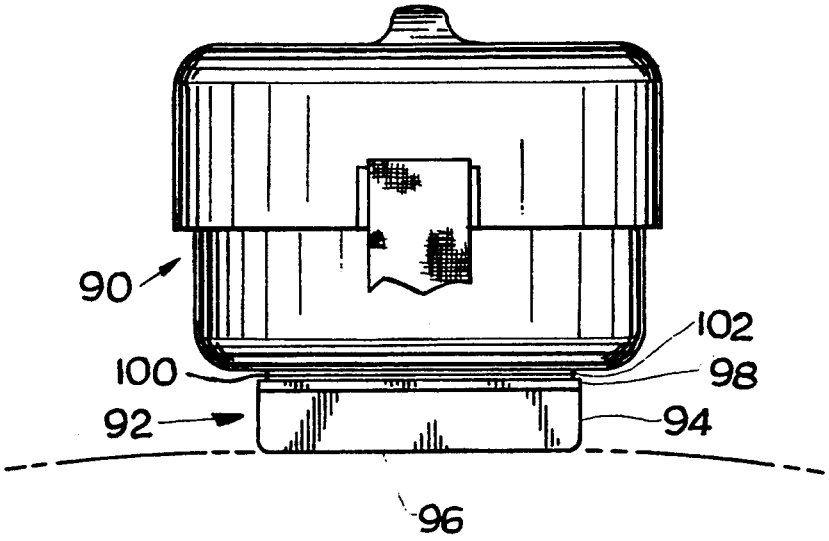
FIG. 9 is a side view of the embodiment of FIG. 8.

FIGS. 8 and 9 show another embodiment of the invention. In this embodiment an existing exercise device 90 is employed. The exemplary product is known as a Tummy Trimmer and made by Dynamic Classics, Inc. and is covered by U.S. Pat. No. 4,775,148. To the bottom of device 90 there is affixed a T-blade 92 which comprises a blade 94 which has a long narrow free surface 96 facing downwardly. Spaced above the surface 96 and rigidly attached perpendicularly to the blade 94 it is a plate 98. On the plate 98 is a length of one side of a hook and loop fastener 100 which mates with the mating side of the hook and loop fastener 102 which is attached to the bottom of the device 90. Thus the entire T-blade 92 can be mounted on and dismounted from the device 90 as desired.

Referring to all the embodiments described above, but with the specific reference to FIGS. 7 through 10 it is important for best operation of the blade in exercising that certain dimensional limits be observed. This is in order to ensure that the blade 70 (FIG. 7) and 94 (FIG. 8 and 9) have sufficient height to be able to be pressed into the abdomen.

Also, other dimensional limits are important where a belt is to be used for attaching the device to the body.

Thus, in FIG. 7 dimension A is 4 inches and dimension B is also 4 inches.

In FIG. 8 dimension D is $5\frac{3}{4}$ inches and dimension C is at least $3\frac{1}{2}$ inches and dimension E is at least $1\frac{1}{2}$ inch.

These dimensions are dictated by the need to be able to press the blade sufficiently deeply into the abdomen and the need to have sufficient downward force developed through the belt to keep the device firmly in place over the abdomen so that when the abdomen is flexed and relaxed, the device will not move with the abdomen, but rather will stay in a place "in space" so that the blade 70 and 94 respectively in FIG. 7 and in FIGS. 8 and 9 can press against the muscles.

Figure 10:
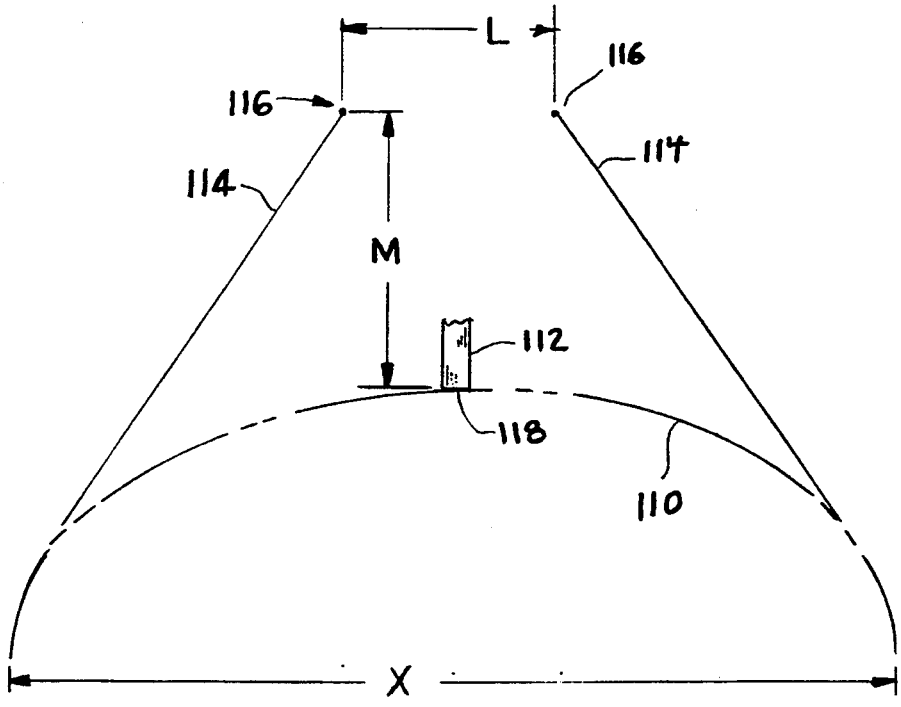
FIG. 10 is a sketch of the preferred arrangement of the invention when held on the user's body.

The sketch of FIG. 10 is helpful in understanding this principle. Line 110 illustrates the abdomen of the user. The blade is shown partially as 112 in contact with the user's abdomen. The lines 114 represent the belt extending from the user's body at an angle to a point 116 where they attach to the device. The more the belt lines 114 are angled toward vertical, the more vertical force will be available to keep the device in place and to provide downward force or resistance. The dimension L is the space between the belt ends where they attached to the device at 116. The dimension M is the height of the belt attachment above the downward facing free surface 118 of the blade 112, which is the part which acts against the abdominal muscles. It has been found that the device will be effective when L is not less than about equal to M, and M is at least 2 inches. This configuration will ensure that the belt is high enough above the blade, and attached spaced apart sufficiently that the belts will be at a steep enough angle to develop the requisite vertical force. Of course the distance x, representing the width of the user's body will effect this conclusion; but the dimensions above are selected to provide for the longest "x" dimension other than persons of the most extreme width.

Referring to FIG. 7, in the configuration where the user's hands grip the holding structure these same dimensions will enable the user to keep his arms and hands comfortably at his sides and still be able to develop the vertical force to keep the device steady in a position "in space" to permit a good exercise for the abdominal muscles.

This device, due to the effect of the downward facing free edge when set vertically and centrally on the abdomen permits exercise of the rectus abdominis muscles. This is done by setting the device in place, vertically and centrally on the abdomen in the position called the linea alba. The device should be pressed into the abdomen somewhat, to a degree depending on the amount of strain desired. The abdomen is then flexed or pushed outward while the device is held in place, resisting the outward push. The initial setting may be from a relaxed or from a pulled-in position of the abdomen. The degree of depression should be between ½ inch to 2 inches in other words, the device to the extent possible is held "in space" while the abdomen is pushed against it. Then the abdomen is relaxed, and the cycle repeated. With the belt the exercise is more precisely set up. On the other hand, when held in place by hand, it is easier to vary the exercise or adjust the position of the downward facing free surface as the user feels and reacts to the effect. For example, the user may want to have the surface press deeper into the abdomen for some number of cycles, and less deep for other cycles. The outward expansion action of the abdomen may be selected to be greater or less. Thus depending on whether greater outward expansion is selected or greater inward pressure is selected, the user can vary the position "in space" of the device; or even let it self adjust at the extreme of the cycle to effect greater or lesser range of movement and force.

The exercise can be done with the device being moved downward into the abdomen instead of the abdomen being flexed upward toward the device; or a combination can be used.

The device can be moved along the abdomen center line, lower toward the pubis or higher toward the sternum to effect exercise of the entire line of rectus abdominis muscles.

Although the present invention has been described with reference to preferred embodiments, numerous modifications and rearrangements can be made, and still the result will come within the scope of the invention.

What is claimed is:

1. A method of exercising to develop abdominal muscles comprising the steps of:

providing an abdominal exerciser having:

a lower portion having a long narrow surface placeable in upstanding contact vertically and centrally of the user's abdomen and an upper portion having a holding structure to enable positioning and retaining of the long narrow surface vertically and centrally on the user's abdomen and to transmit muscle resisting downward force;

holding the exerciser in place on the user's abdomen with the long narrow surface vertically and centrally in place on the abdomen;

exerting the abdominal muscles against the exerciser and relaxing the abdominal muscles.

2. A method of exercising to develop abdominal muscles comprising the steps of:

providing an abdominal exerciser having:

a portion having a long narrow surface for upstanding contact vertically and centrally on the user's abdomen;

placing the long narrow surface upstanding in contact vertically and centrally on the user's abdomen;

exercising the abdominal muscles by cyclically exerting said muscles against the long narrow surface and relaxing said muscles; and resisting the exertion of said muscles against the long narrow surface by applying force to said exerciser.

3. The method of claim 2 further comprising providing a holding structure to an upper portion of said abdominal exerciser to receive force to retain the exerciser in place and enable the application of said downward force.

4. The method of claim 3 further comprising providing an adjustable belt attached to the holding structure for extending about the user to hold the abdominal exerciser in place and to establish a selected tightened position of the long narrow surface on the user's abdomen.

5. The method of claim 4 further comprising providing a portion for receiving and holding a weight above the long narrow surface.

6. The method of claim 5 further comprising providing a soft cover on said long narrow surface to soften its contact with the user's body.

7. A method of exercise to develop the rectus abdominous muscles comprising the steps of;

providing an abdominal exerciser having:

a lower portion having a long narrow surface placeable in isolated upstanding contact with the user's linea alba and an upper portion having a holding structure to enable positioning and retaining of the long narrow surface on the user's linea alba and having left and right hand gripping members as part of the upper portion spaced above the lower portion and spaced laterally to each side of the lower portion to transmit muscle resisting downward force;

holding the exerciser on the user's abdomen by gripping the gripping members with the left and right hand with the long narrow surface in place on the linea alba;

exerting force against the linea alba by pulling downward with the left and right hands on the gripping members;

cyclically exerting the rectus abdominous muscles against the downward force and relaxing said muscles.

* * * * *

UNITED STATES PATENT AND TRADEMARK OFFICE

CERTIFICATE OF CORRECTION

PATENT NO. : 5,401,228

DATED : March 28, 1995

INVENTOR(S) : Gary McLaughlin

It is certified that error appears in the above-indentified patent and that said Letters Patent is hereby corrected as shown below:

On the title page: Item [63] change to read -- Continuation-in-part of Ser. No. 809,088, Dec. 10,1991, abandoned, which is a continuation of Ser. No. 556,133, July 23, 1990 now abandoned --.

Column 1, line 7, change to read --07/556,133 filed July 23, 1990, now abandoned --.

Signed and Sealed this

Sixteenth Day of July, 1996

*Attest:*

*Attesting Officer*

BRUCE LEHMAN

*Commissioner of Patents and Trademarks*